US006758192B2

(12) United States Patent
Vanderveen et al.

(10) Patent No.: US 6,758,192 B2
(45) Date of Patent: Jul. 6, 2004

(54) VEHICLE NON-METALLIC INTAKE MANIFOLD HAVING AN INTEGRATED METALLIC FUEL RAIL

(75) Inventors: James K. Vanderveen, Blehelm (CA); James Russell Morris, Newport News, VA (US); Ki-Ho Lee, Windsor (CA)

(73) Assignee: Siemens VDO Automotive Inc., Chatham (CA)

( * ) Notice: Subject to any disclaimer, the term of this patent is extended or adjusted under 35 U.S.C. 154(b) by 0 days.

(21) Appl. No.: 10/443,198

(22) Filed: May 22, 2003

(65) Prior Publication Data

US 2003/0230283 A1 Dec. 18, 2003

Related U.S. Application Data

(60) Provisional application No. 60/389,582, filed on Jun. 18, 2002, provisional application No. 60/389,595, filed on Jun. 18, 2002, provisional application No. 60/389,824, filed on Jun. 19, 2002, and provisional application No. 60/397,707, filed on Jul. 22, 2002.

(51) Int. Cl.[7] ..... F02M 35/10; F02M 55/02

(52) U.S. Cl. ..... 123/456; 123/468; 123/470; 123/184.47; 123/184.61

(58) Field of Search ..... 123/456, 468, 123/470, 184.21, 184.34, 184.42, 184.47, 184.61

(56) References Cited

U.S. PATENT DOCUMENTS

| | | | | | |
|---|---|---|---|---|---|
| 4,295,452 | A | * | 10/1981 | Lembke et al. | 123/470 |
| 4,776,313 | A | * | 10/1988 | Freismuth et al. | 123/470 |
| 5,163,406 | A | * | 11/1992 | Daly et al. | 123/456 |
| 5,533,485 | A | * | 7/1996 | Bronkal | 123/456 |
| 5,682,859 | A | * | 11/1997 | Wakeman | 123/470 |
| 5,771,863 | A | * | 6/1998 | Daly | 123/456 |
| 6,148,797 | A | * | 11/2000 | Gmelin | 123/456 |
| 6,186,106 | B1 | * | 2/2001 | Glovatsky et al. | 123/143 C |
| 6,308,686 | B1 | * | 10/2001 | Mammarella et al. | 123/470 |

* cited by examiner

*Primary Examiner*—Weilun Lo

(57) ABSTRACT

An intake manifold (10) includes a fuel rail cavity (30) which receives a metallic fuel rail (14) enclosed by a molded fuel rail cavity cover (32). The fuel rail (14) communicates with each of a plurality of engine cylinders (16) through a fuel module (18). An injector cup (28) fits upon each module cylinder to provide an interface between the fuel module and the fuel rail. Another intake manifold (10) includes a fuel rail (14) which directly interfaces with each fuel module (18) through a bellows (38) attached directly thereto.

8 Claims, 5 Drawing Sheets

VEHICLE NON-METALLIC INTAKE MANIFOLD HAVING AN INTEGRATED METALLIC FUEL RAIL

The present application claims priority to U.S. Provisional Patent Application Serial Nos. 60/389,582 and 60/389,595, both filed Jun. 18, 2002; U.S. Provisional Patent Application Serial No. 60/389,824 filed Jun. 19, 2002; and U.S. Provisional Patent Application Serial No. 60/397,707, filed Jul. 22, 2002.

BACKGROUND OF THE INVENTION

The present invention relates to a non-metallic vehicle air intake manifold and, more particularly, to an intake manifold which provides a fuel rail cavity for receiving a metallic fuel rail which is enclosed by a molded fuel rail cavity cover.

An air intake manifold distributes air to a vehicle engine's cylinders. The manifold is located on the engine in the engine compartment of a vehicle. The intake manifold primarily includes a plurality of runners which communicate and distribute air to the engine cylinders. The runners are of a particular geometry to assure proper air flow thereto. One of the major factors that influences engine performance as determined by the air intake manifold, is the air flow runner length and their sectional area. Recently, non-metallic materials are used in the manufacture of air intake manifolds.

Recently, attempts have been made to mold a metallic fuel rail into the non-metallic intake manifold to minimize permeation of fuel therefrom. Overmolding a metallic fuel rail into the intake manifold may be relatively difficult, as the molding tool must interface against a relatively imprecise and thin walled fuel rail. Due to the imprecise interface, gaps or series of gaps may result between the molding tool and the fuel rail. Molded openings for a plurality of injector cups which interface with the fuel rail must also be maintained during the molding process which may likewise result in the formation of gaps. During the molding process, these gaps may fill with flash. The flash may potentially sever injector O-rings during installation, may inhibit injector installation, and may later detach and clog the fuel system.

Accordingly, it is desirable to provide a non-metallic air intake manifold having a metallic fuel rail and a method of manufacture therefor without the aforementioned assembly difficulties.

SUMMARY OF THE INVENTION

The intake manifold according to the present invention provides a fuel rail cavity which receives a metallic fuel rail which is enclosed by a molded fuel rail cavity cover.

The fuel rail is manufactured of a metallic material through a hydroforming, stamping, casting, semi-solid forming or other metal forming process. By separately locating the metallic fuel rail within the fuel rail cavity, alignment of fuel rail injector openings with each module cylinders and injector cup is readily facilitated.

The fuel rail communicates with each of a plurality of engine cylinders through a fuel module. A fuel module carrier assembly having module carriers is mounted between a lower manifold portion and the vehicle engine. The module carriers are cylindrical members that fit into corresponding module cylinders which extend from the lower manifold portion. An injector cup fits upon each module cylinder to provide an interface between the fuel module and the fuel rail.

Another intake manifold includes a fuel rail that directly interfaces with each fuel module through a bellows attached directly thereto. Each bellows is manufactured of a metallic material and attached directly to the fuel module and the fuel rail without the requirement of a resilient seal.

The present invention therefore provides a non-metallic air intake manifold having a metallic fuel rail and a method of manufacture therefor without the aforementioned assembly difficulties.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
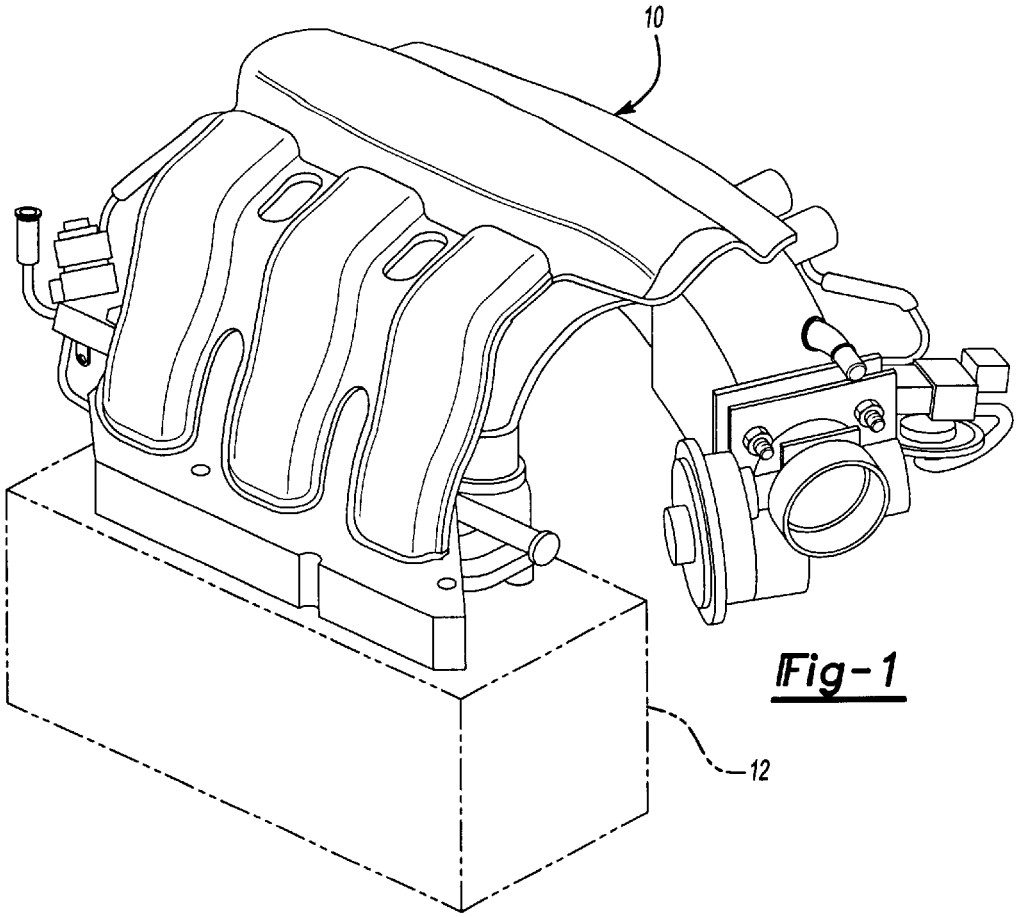
FIG. 1 is a general perspective view an intake manifold for use with the present invention.
Figure 2:
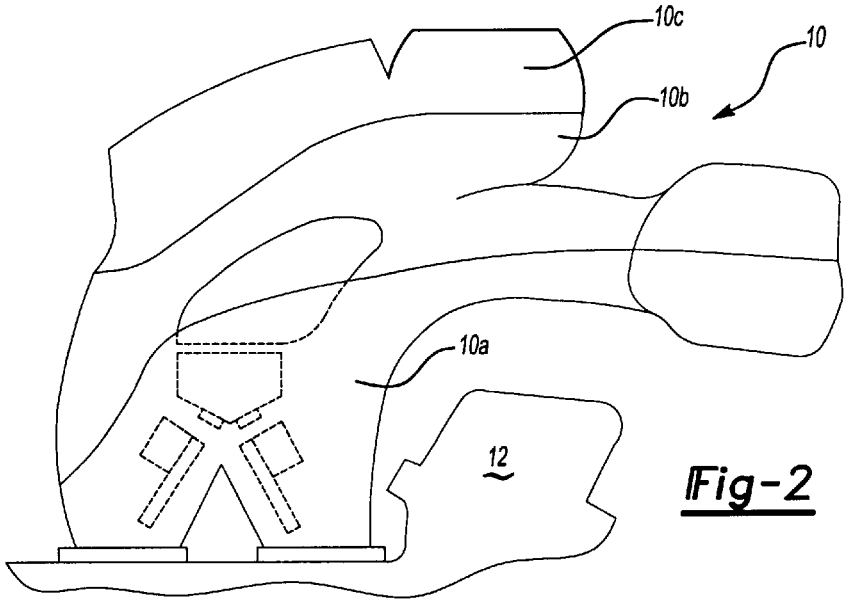
FIG. 2 is a general sectional view of the intake manifold of FIG. 1.

FIG. 1 illustrates a general perspective view of an intake manifold assembly 10 mounted to an internal combustion engine 12 to provide for regulation of an air fuel mixture. The manifold is preferably a non-metallic molded plastic manifold which is manufactured of a plurality of sections 10*a*, 10*b*, 10*c* (FIG. 2). It should be understood that any number of sections and interface locations will benefit from the present invention.

Figure 3:
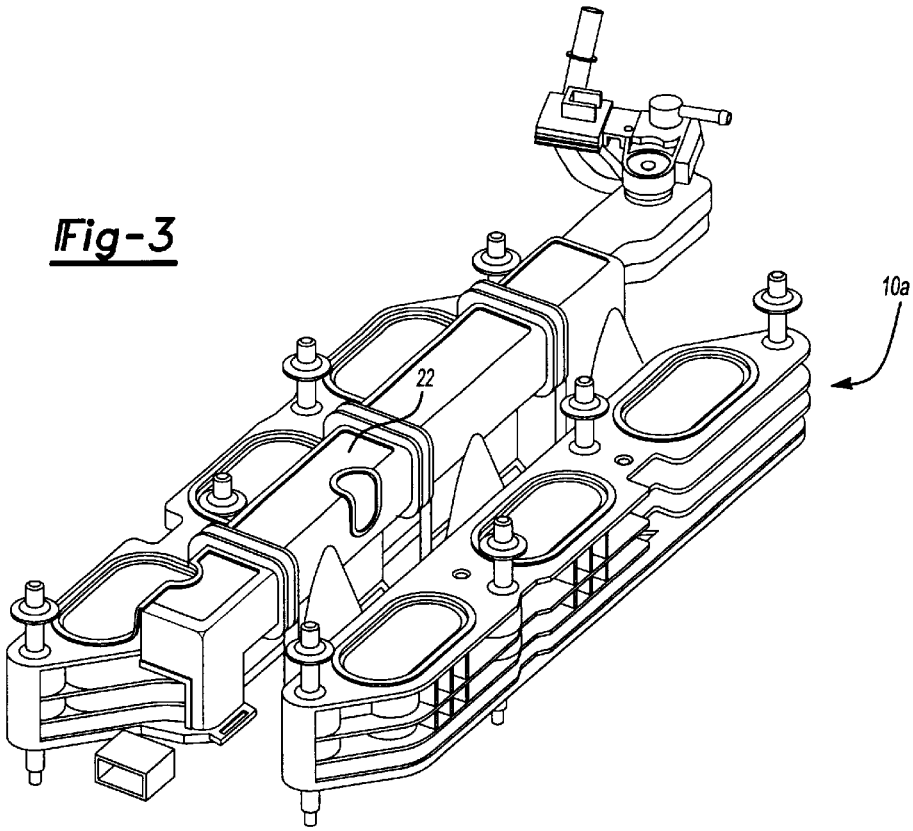
FIG. 3 is a general perspective view of a lower portion of an intake manifold of FIG. 1.
Figure 4:
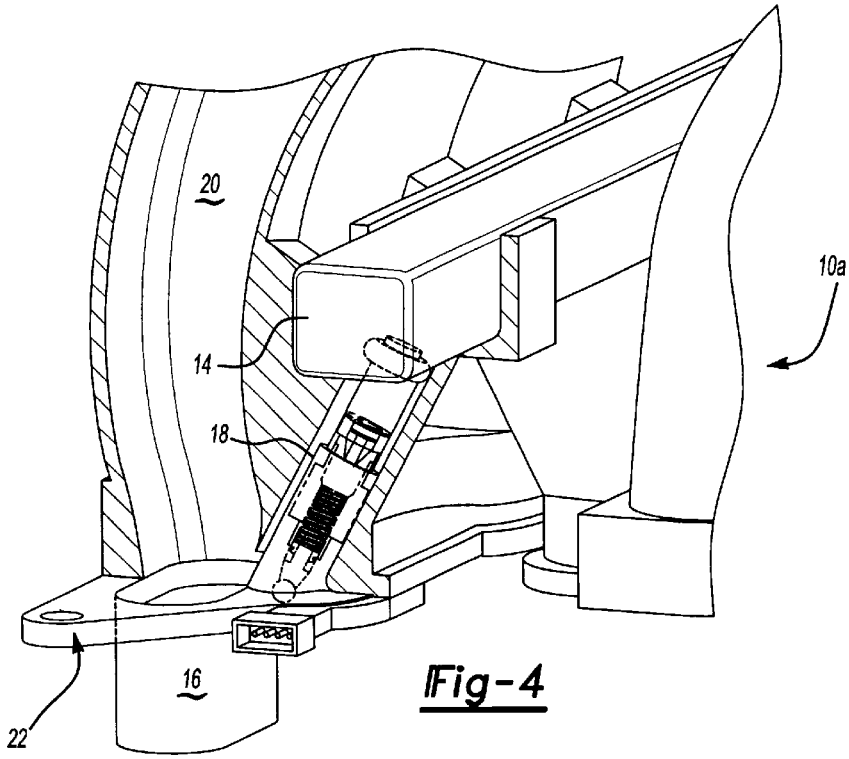
FIG. 4 is a partial sectional view of the a lower intake manifold portion.

Referring to FIG. 3, the lower manifold portion 10*a* is illustrated. The lower manifold assembly is defined as a "lower" assembly because it is a portion of the intake manifold which is closest to the engine 12. It should be understood that relative positional terms such as "forward," "aft," "upper," "lower," "above," "below," and the like are with reference to the normal operational attitude of the vehicle and should not be considered otherwise limiting. The lower manifold assembly 10*a* receives a fuel rail 14 (FIG. 4). The fuel rail 14 is preferably manufactured of a metallic material through a hydroforming, stamping, casting, semi-solid forming or other process.

Referring to FIG. 4, the fuel rail 14 communicates with each of a plurality of engine cylinders (illustrated schematically at 16) through a fuel injector (illustrated schematically at 18). Fuel fills the fuel rail 14 and is communicated into each engine cylinder 16 through operation of the fuel modules 18 (also illustrated in FIG. 5). The fuel modules 18 regulate the amount of fuel mixed with air drawn through the intake manifold 10 and into the engine 12.

Figure 6:
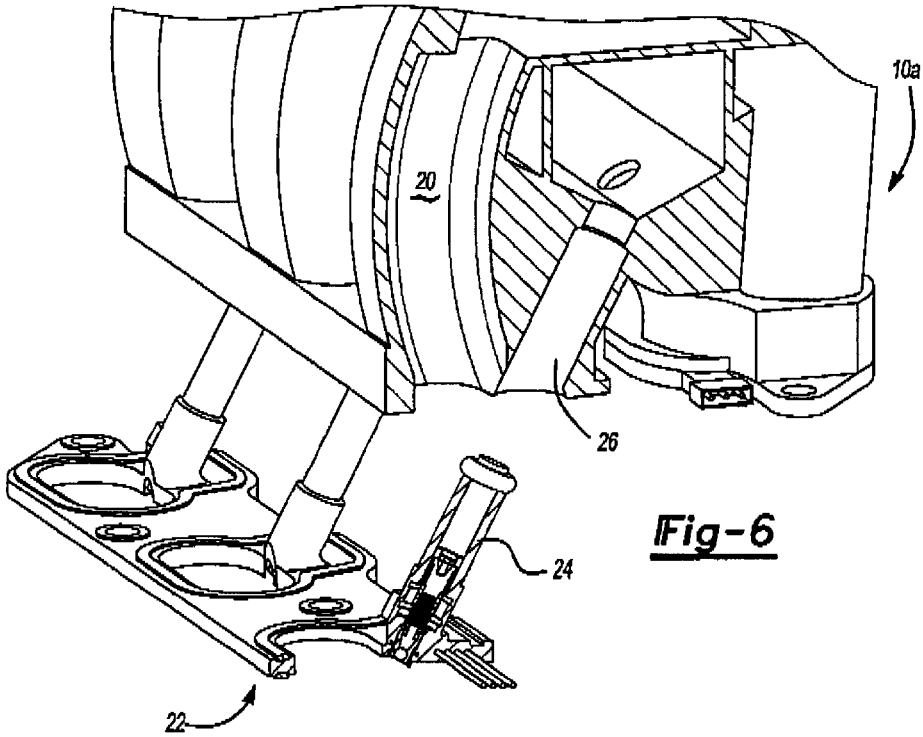
FIG. 6 is a partial sectional view of a lower intake manifold and fuel module carrier assembly.

A runner 20 formed in the manifold assembly 10 communicates the airflow to each engine cylinder 16 within the engine 12. A fuel module carrier assembly 22 having module carriers 24 (FIG. 6) is preferably mounted between the lower manifold assembly 10*a* and the engine 12. The module carriers 24 are preferably cylindrical members which fit into corresponding module cylinders 26 which extend from the lower manifold portion 10*a* in a male/female relationship (FIG. 6). That is, the modules 18 fit into the module carriers 24, which fit into the module cylinders 26 formed as part of the lower manifold portion 10*a*.

Figure 5:
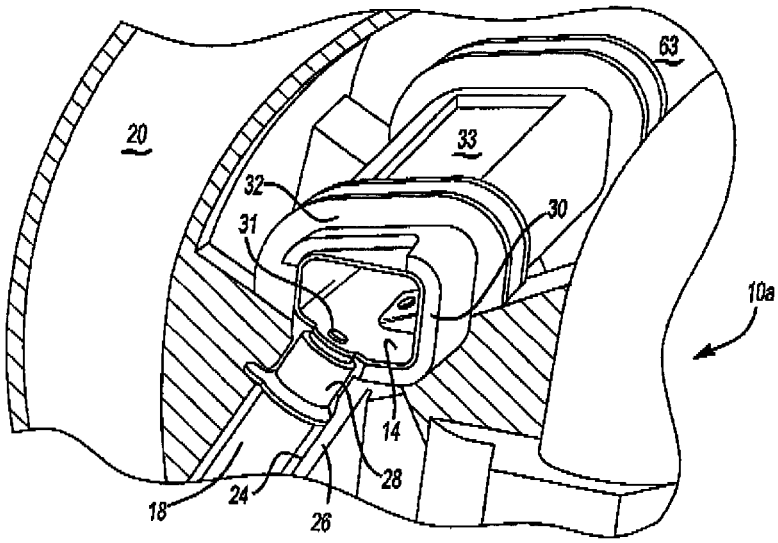
FIG. 5 is a sectional view of the fuel rail cavity of within a lower intake manifold portion illustrated in FIG. 4.

Referring to FIG. 5, an injector cup 28 fits upon each module cylinder 26 to provide an interface between the fuel carrier 24 and the fuel rail 14. The injector cup 28 accommodates the interface between the fuel rail 14 and the module carrier 24. That is, the injector cup provides an interface that overcomes the tolerance variation therebetween.

Figure 7:
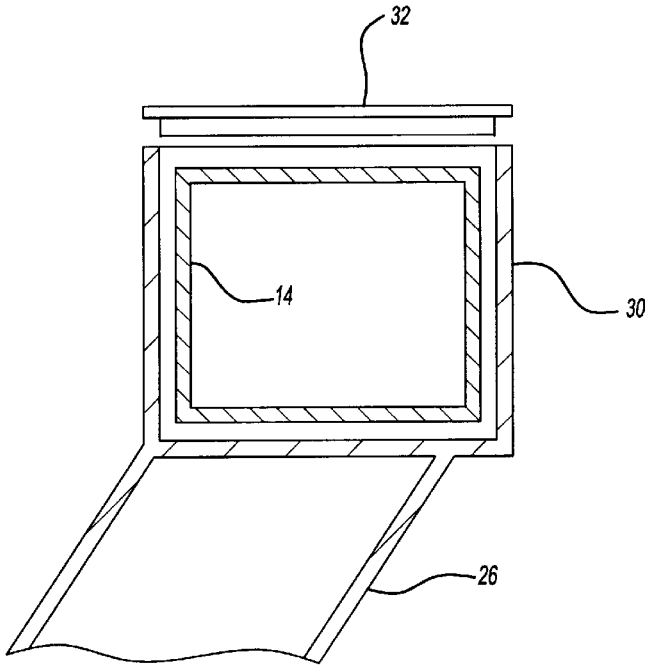
FIG. 7 is a sectional view of the fuel rail cavity.

The present invention utilizes a lower manifold portion 10*a*, which defines a fuel rail cavity 30 and a non-metallic fuel rail cavity cover 32 (also illustrated in cross-section at FIG. 7). The fuel rail cavity cover 32 may include a plurality of openings 33 to accommodate pressure pulsation of the fuel rail 14.

The fuel rail cavity 30 receives the metallic fuel rail 14 which may be formed of multiple portions. The fuel rail 14 is then located, sealed and protected by the fuel rail cavity cover 32. Preferably, the cover 32 is at least partially laser transmissive to accommodate laser welding.

Figure 8:
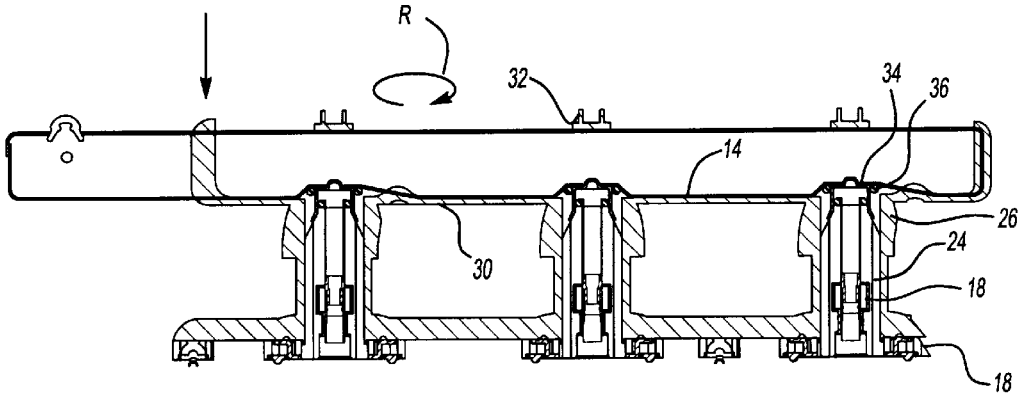
FIG. 8 is a schematic sectional view of a fuel rail cavity cover being assembled to the fuel rail cavity.

By separately locating the metallic fuel rail 14 within the fuel rail cavity 30 alignment of each fuel rail injector opening 34 with each module cylinders 26 and injector cup 28 is readily facilitated. Additionally, a resilient seal 36 (FIG. 8) is located about each fuel rail injector opening to further contain fuel vapor.

Preferably, a roller R (FIG. 8) presses upon the fuel rail cavity cover 32 as the fuel rail cavity cover 32 is laser welded over the fuel rail cavity 30. The location of the fuel rail 14 within the fuel rail cavity 30 is provided with a reference interface surface to which the injector cups 28 are referenced. That is, when the fuel rail is positioned with regard to the reference surface and the fuel rail cavity cover 32 is properly aligned and mounted to the fuel rail cavity 30, the fuel rail 14 and the injector opening 34 are resultantly properly located and positioned relative the reference surface. The reference surface may be, for example, the inner bottom surface of the fuel rail cavity 30 or the inner surface of the cover 32. It should be understood that various fuel rail cavity cover 32 to cavity 30 interfaces, reference surfaces and interconnection methods will benefit from the present invention.

The present invention eliminates the requirement of molding a metallic fuel rail component directly into the non-metallic manifold. Moreover, the fuel rail cavity cover 32 may be later broken away to service or replace a damaged fuel rail.

Figure 9:
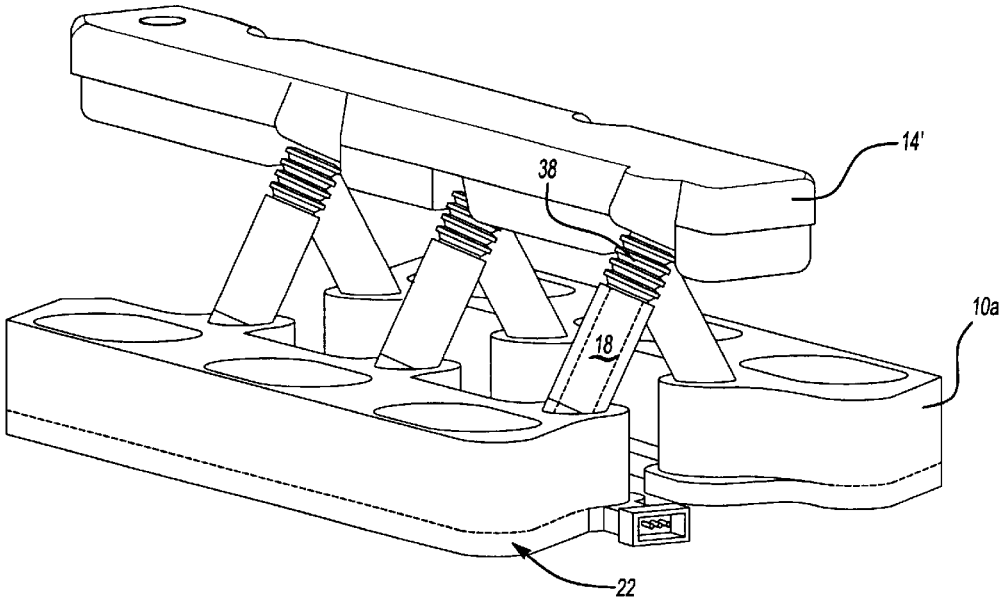
FIG. 9 is another lower intake manifold portion.
Figure 10:
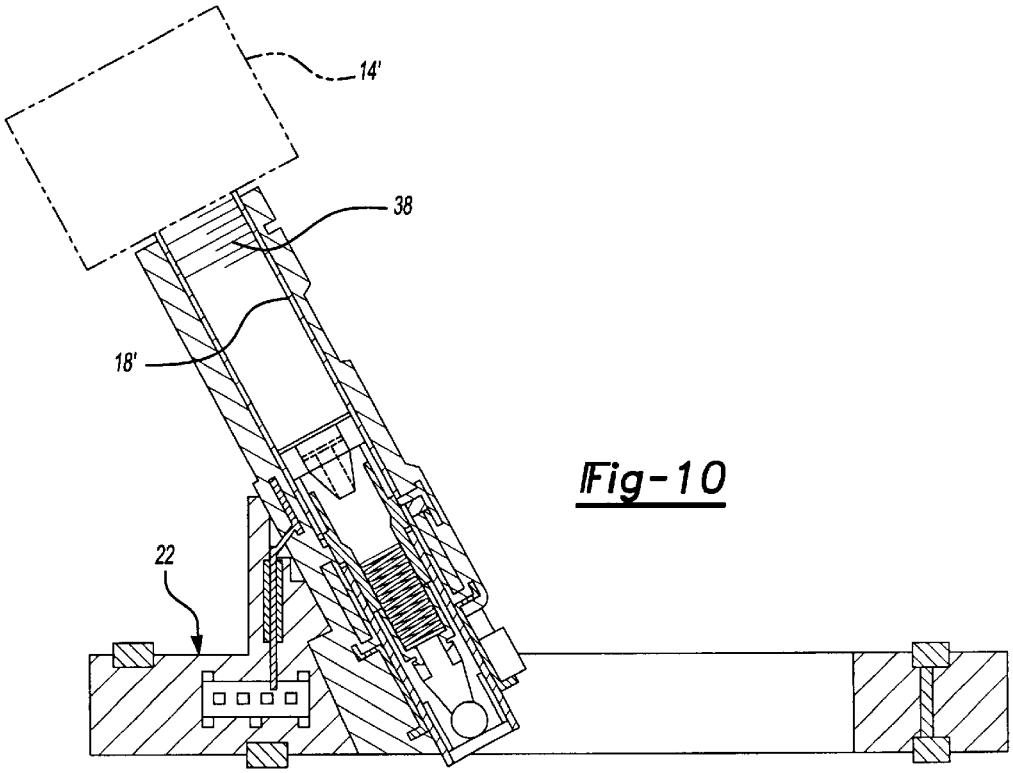
FIG. 10 is a sectional view of a fuel rail illustrated in FIG. 9 and fuel module attached thereto.

Referring to FIG. 9, another fuel rail 14' directly interfaces with each fuel module 18 through a bellows 38 attached directly thereto. Each bellows 38 is manufactured of a metallic material, preferably of the same material of which the modules 18' are manufactured. Each bellows 38 is attached directly to the fuel module 18' which is then welded directly to the fuel rail 14' without the requirement of a resilient seal. The fuel modules 18' may be installed individually or may alternative be installed in a fuel module carrier assembly 22 as described above. That is, the bellows 38 replaces the injector cup and provides a compliant interface that overcomes the tolerance variations between the modules 18' and the fuel rail 14'. Moreover, the bellows 38 are unlikely to be damaged by flash or the like as compared to a non-metallic resilient seal.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A non-metallic intake manifold assembly comprising:

an intake manifold portion comprising a plurality of tanners, said intake manifold portion formed of a non-metallic material;

a fuel rail cavity integrally formed within said intake manifold portion;

a plurality of module cylinders integrally formed within said intake manifold portion, said plurality of module cylinders in communication with said fuel rail cavity;

a metallic fuel rail located within said fuel rail cavity;

a fuel rail cavity cover to at least partially enclose said metallic fuel rail within said fuel rail cavity;

a fuel module carrier assembly comprising a plurality of fuel module carriers each of said plurality of fuel module carriers receivable within each of said plurality of module cylinders; and a fuel module received within each of said plurality of fuel module carriers, said fuel modules in communication with said fuel rail.

2. The intake manifold as recited in claim 1, wherein said metallic fuel rail is oriented by said fuel rail cavity.

3. The intake manifold as recited in claim 1, wherein said metallic fuel rail is oriented by said fuel rail cavity cover.

4. The intake manifold as recited in claim 1, further comprising an injector cup between each of said plurality of fuel module carriers and said fuel rail.

5. The intake manifold as recited in claim 4, further comprising a seal between each of said fuel modules and each of said injector cups.

6. The intake manifold as recited in claim 1, further comprising a bellows between each of said fuel modules and said fuel rail.

7. The intake manifold as recited in claim 6, wherein said bellows extends from said fuel module.

8. The intake manifold as recited in claim 6, wherein said bellows is welded to said fuel module and said fuel rail.

* * * * *